US007637283B2

(12) United States Patent
Hoffman

(10) Patent No.: US 7,637,283 B2
(45) Date of Patent: Dec. 29, 2009

(54) PRESSURE RELIEF VALVE WITH STIFF SUPPORT

(75) Inventor: Karl K. Hoffman, Arlington Heights, IL (US)

(73) Assignee: Plitek, L.L.C., Des Plaines, IL (US)

( * ) Notice: Subject to any disclaimer, the term of this patent is extended or adjusted under 35 U.S.C. 154(b) by 600 days.

(21) Appl. No.: 11/133,914

(22) Filed: May 20, 2005

(65) Prior Publication Data

US 2006/0263497 A1 Nov. 23, 2006

(51) Int. Cl.
*F16K 15/14* (2006.01)
*A23K 1/18* (2006.01)

(52) U.S. Cl. ..... 137/843; 137/852; 220/89.2; 383/103; 426/118

(58) Field of Classification Search ..... 137/843, 137/852; 220/89.2; 383/103; 426/118
See application file for complete search history.

(56) References Cited

U.S. PATENT DOCUMENTS 4,000,846 A * 1/1977 Gilbert ..... 383/103
5,337,179 A * 8/1994 Hodges ..... 359/443
5,584,409 A * 12/1996 Chemberlen ..... 220/89.1
5,727,881 A * 3/1998 Domke ..... 383/103
5,782,266 A * 7/1998 Domke ..... 137/551
6,663,284 B2 * 12/2003 Buckingham et al. ..... 383/103
7,178,555 B2 * 2/2007 Engel et al. ..... 137/852
7,331,715 B2 * 2/2008 Miller et al. ..... 383/103
2004/0050437 A1 * 3/2004 Engel et al. ..... 137/843

* cited by examiner

*Primary Examiner*—Kevin L Lee
(74) *Attorney, Agent, or Firm*—Niro, Scavone, Haller & Niro

(57) ABSTRACT

The present invention creates a new rigid degassing valve. The valve of the present invention utilizes a relatively stiff support body in order to successfully vent gases, such as carbon dioxide, from within the packaging. Carbon dioxide may be created by organic products placed in the packaging which causes the package to expand. The valve of the current invention maintains its shape as the package becomes bloated and takes on a rounded shape due to carbon dioxide expended by the roasted coffee beans.

The invention pertains to a pressure relief valve for use on packaging containers comprising a stiff support body mountable to a package surface defining an inner aperture wherein the stiff support body has a stiffness of between 300 grams and 800 grams; a flexible film having a top and bottom surface mounted to said stiff base and moveable between an open and closed position; a rail mounted on said stiff base permitting the flexible film to move between an open and closed position; in said open position said film is located above said aperture; in said closed position, said film covers said aperture; and wherein the stiff support body does not conform with any curvature of the packaging surface such that the flexible film may move between an open and closed position regardless of the curvature of the packaging surface.

27 Claims, 1 Drawing Sheet

PRESSURE RELIEF VALVE WITH STIFF SUPPORT

BACKGROUND OF THE INVENTION

The present invention is based on a pressure relief valve used on a packaging container. More specifically, the invention relates to using relatively stiff support members which prevent the valve from conforming to the shape of the packaging and blocking the flow of gas through the valve.

Exposure to oxygen may harm many food products. Therefore, organic products that are vulnerable to oxygen, such as coffee, are packed in tightly sealed containers to prevent spoilage through exposure to oxygen. Unfortunately, freshly roasted coffee products often produce carbon dioxide gas that increases the pressure within the package causing the package to expand.

The problem solved by this invention pertains to products placed in larger packages varying in size from 1 to 10 pounds. When larger packages, made of flexible material, contain roasted whole bean or ground coffee, the package tends to expand due to the carbon dioxide gas released from the coffee beans. Since there is more coffee contained in larger packaging, after the roasting/packaging process, the soft flexible packaging becomes bloated due to the expended carbon dioxide gas, taking the shape of a round, cylindrical, pillow-shaped object.

Valves currently on the market have flexible support structures that tend to take the shape of the bloated package, thus, decreasing or entirely preventing the flow of carbon dioxide or air through the valve. The existing valves on the market, such as the valve disclosed on U.S. Pat. No. 5,727,881, do not utilize a stiff support body. Thus, the valve disclosed in U.S. Pat. No. 5,727,881 will conform with the shape of the bloated packaging. Moreover, the valves currently on the market will eventually cease to function when the packaging becomes bloated since the support structure and the valve diaphragm conform with the rounded shape. The valve diaphragm cannot open which in turn prevents gas from flowing through the valve as intended. Essentially, the current valves do not function as they should when a package becomes bloated because the valve conforms with the curved, cylindrical shape preventing the valve from releasing carbon dioxide created by the roasted coffee. The packaging will eventually fill with gas and burst.

SUMMARY OF THE INVENTION

The present invention creates a new rigid degassing valve. The valve of the present invention utilizes a relatively stiff support body in order to successfully vent gases, such as carbon dioxide, from within the packaging. Carbon dioxide may be created by organic products placed in the packaging which causes the package to expand. The valve of the current invention maintains its shape as the package becomes bloated and takes on a rounded shape due to carbon dioxide expended by the roasted coffee beans. The valve diaphragm, or flap, will open regardless of the curvature of the packaging due to the stiffness of the stiff support body. The package will become a round, cylindrical, pillow shaped object as carbon dioxide is released from the roasted coffee beans into the package, while the valve will remain flat on the outside of the package due to its rigidity and thickness of the stiff support body. When the specified internal pressure is reached due to the carbon dioxide build up, the valve will open, degassing the package and reclose, so as to minimize the oxygen flow entering the package through the valve. Overall, the valve will effectively release the built-up carbon dioxide from the package and reclose to effectively minimize the flow of oxygen back into the package through said valve.

Some of the advantages offered by the present invention include:

1. The valve allows packaging for freshly roasted coffee, with a high propensity for degassing, to release the built up carbon dioxide created from roasted coffee grounds and beans. This happens between the specified internal pressure of 0.08 psi up to 0.30 psi.
2. The valve minimizes the flow of oxygen back into the package. Coffee quality degenerates when it is exposed to oxygen.
3. The valve utilizes the existing equipment for the manufacturing process.
4. The valve functions on large, roasted, whole bean or ground coffee packaging.

DESCRIPTION OF THE DRAWINGS

These and other features, objects and advantages of the present invention will become apparent from the following description and drawings wherein like reference numerals represent like elements in several views, and in which.

DESCRIPTION OF THE PREFERRED EMBODIMENTS

Figure 1:
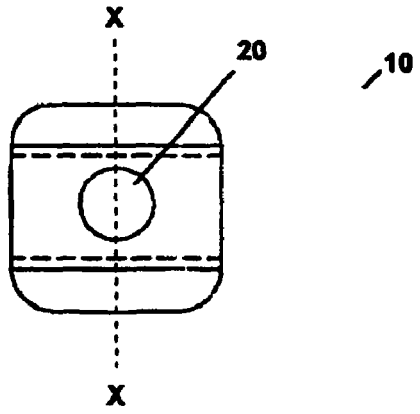
FIG. 1 is a top view of a valve having a circular-shaped vent.

Set forth below is a description of what are currently believed to be the preferred embodiments or best examples of the invention claimed. Future and present alternatives and modifications to the preferred embodiments are contemplated. Any alternates or modifications having insubstantial changes in function, in purpose, in structure or in result are intended to be covered by the claims of this patent.

As shown in FIGS. 1, 2, 3 and 4, one embodiment of the present invention includes a pressure relief valve 10 having a stiff support body 11 which may include an adhesive layer 12 and a release liner 14. The adhesive layer 12 allows the base to be mounted to a package or support surface 16.

An aperture 20 is included on the stiff support body 11 which is often located over an opening on package 16. The aperture 20 forms a chamber 21 through which a gas may vent through and opening in the package 16. This occurs when the pressure inside the package 16 is greater than the pressure outside the package 16. The stiff support body 11 is made of a rigid material having a stiffness between 300 gram-centimeters and 800 gram centimeters deflection force. The term "stiff", as used in this patent, means hard to bend or stretch, rigid, firm, not very flexible or pliant, or any ordinary or accustomed meaning associated with the term. The stiffness may be measured by the ASTM-D790 test method. The stiff support body 11 prevents the pressure relief valve 10 from conforming to the curvature of the packaging when the contents of the package 16 release a gas, such as carbon dioxide, or expand (or bloat) the packaging. The stiff support body 11 must have a sufficient stiffness to prevent the pressure release valve 10 from conforming to the curvature of the package 16. The stiff support body 11 is preferably 0.014" to 0.019" thick. The stiff support body 11 may be made of a number of materials know to those of skill in the art including polyester, polyolephin, styrene, polypropylene or polycarbonate, so long as it has a measured stiffness of between 300 gram centimeters to 800 gram centimeters deflection force.

A substitution of the thin gauge base film of original degassing valve to a thicker, more rigid base film prevents the valve from taking the shape of the round, cylindrical, pillow shaped package that is formed while carbon dioxide is released by the roasted coffee into the package 16. The rigidity and thickness of said pressure relief valve 10 does not allow for a change in shape of the pressure relief valve 10, thus allowing said pressure relief valve 10 to function normally. In order to function normally, the pressure relief valve 10 will release the built up carbon dioxide and effectively minimize the oxygen flow back into the package 16.

If pressure is accumulated in the interior of the package 16 from the emission of carbon dioxide from a product in the package 16 such as coffee, the internal pressure of the gas within the package 16 causes the package 16 to expand. The internal pressure also causes the gases created by the product to exit through the aperture 20 into the chamber 21. As the internal pressure increases, the middle portion of the laminating film 18 bulges and lifts outward from the stiff support body 11, so that a chamber 21 forms between the stiff support body 11 and the laminating film 18 in the non-adhesive area parallel to the stiff support body 11. Gas can flow outward along the laminating film 18 if the stiff support body 11 does not have a stiffness of 300 gram-centimeters or greater, the stiff support body 11 will flex and conform with the curvature of the packaging. When the new style valve is used, the laminating film 18 cannot bulge or lift upward if the stiff support body 11 flexes with the curvature of the package 16. If the stiff support body 11 has a stiffness of 300 gram-centimeters or greater, the supports remain rigid, the valve does not conform to the curvature of the package 16, and the laminating film 18 along with the dry strap 23 open causing a displacement or lift to permit the internal gas to escape.

As is also shown in FIGS. 1-4, rails 22 and 24 are provided on the laminating film 18. Rails 22 and 24 may be a polypropylene material, an adhesive layer 26 and 28 that has been applied to the base or some other suitable material known to those of skill in the art. The thickness of the rails 22 and 24 should be about 1 to 10 millimeters, with a preferred thickness of 4-6 millimeters.

The rails 22 and 24 are located a spaced distance from aperture 20 to form a passageway 21 which is recessed from aperture 20.

Figure 2:
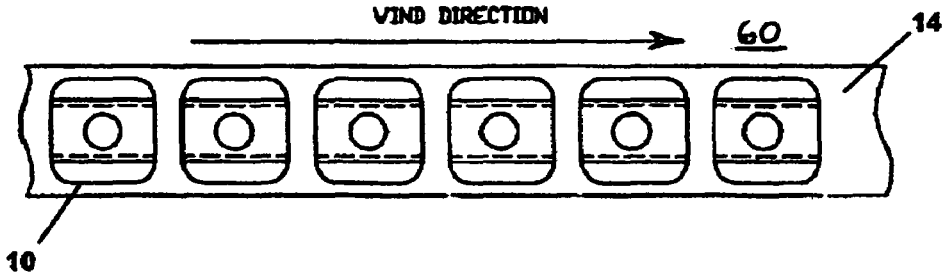
FIG. 2 is a top view of the valves on a release liner.

A film or membrane 18 is also provided which is supported by dry strap 23. The film may be made of Polyethylene Terephthalate by DuPont. In addition, a plurality of pressure relief valves 18 may be formed on a roll 60 as shown in FIG. 2 in a manner known to those of ordinary skill in the art.

In operation, a laminating film 18 is in a closed position and extends inwardly to cover aperture 20. In this position, a laminating film 18 acts as a seal which prevents exposure to the outside environment.

Figure 3:
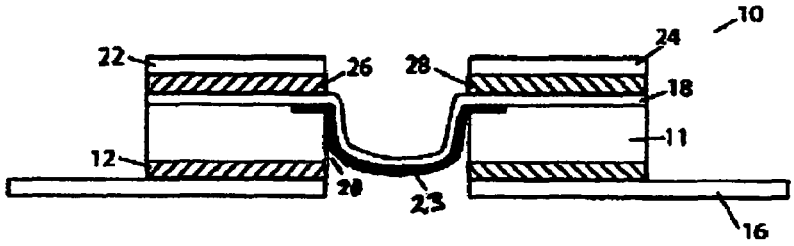
FIG. 3 is a cross-sectional view of the valve in a closed position.
Figure 4:
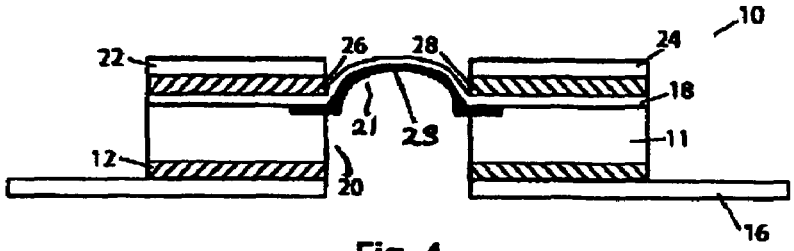
FIG. 4 is a cross-sectional view of the valve in an open position.

As shown in FIGS. 3 and 4, to vent the contents, a laminating film 18 moves into an open position through the force created by the pressurized gas located in package 16. The pressure of the gas moves laminating film 18 upward with respect to aperture 20. This, in turn, permits aperture 20 to be in communication with the passageway so as to allow venting to occur. Once the pressure in the package equalizes, laminating film 18, again, moves inwardly to cover and seal off the aperture.

In an open position, the chamber 21 and aperture 20 form a gas passageway which permits venting to occur. By permitting laminating film 18 to move downwardly and upwardly within a space defined by the passageway, contact by extraneous surfaces or objects with laminating film 18 will not interfere with the operation of the pressure relief valve 10.

If the stiff support body 11 is flexible, when the surface of the package 16 curves, the stiff support body 11 would also curve preventing the laminating film 18 from lifting to allow the gas to escape through the chamber 21. When the stiff support body 11 has a stiffness of 300 gram-centimeters or greater, the stiff support body 11 does not curve with the curvature of the package 16. Thus, the film 50 may lift to form a bubble to permit gas to escape through chamber 21 since the stiff support body 11 does not curve.

While the invention has been described with reference to the preferred embodiments thereof, it will be appreciated that numerous variations, modifications, and alternate embodiments are possible, and accordingly, all such variations, modifications, and alternate embodiments are to be regarded as being within the spirit and scope of the invention.

It should be understood that various changes and modifications to the preferred embodiments described would be apparent to those skilled in the art. Changes and modifications can be made without departing from the spirit and scope of the present invention and without diminishing its intended advantages. It is, therefore, intended that such changes and modifications be covered by the following claims.

What is claimed is:

1. A pressure relief valve for use on a packaging surface of packaging containers comprising:

a stiff support body mountable to a package surface defining an inner aperture wherein the stiff support body has a stiffness of between around 300 gram-centimeters and around 800 gram-centimeters;

a flexible film having a top and bottom surface mounted to said stiff support body and movable between an open and closed position;

a rail mounted above said flexible film holding said flexible film to said stiff support body and permitting the flexible film to move between an open and closed position;

wherein:

in said open position, said film is located above said aperture;

in said closed position, said film covers said aperture; and wherein the stiff support body does not conform with any curvature of the packaging surface such that the flexible film may move between said open and closed position regardless of the curvature of the packaging surface.

2. The device of claim 1 wherein said stiff support body is adhered to the packaging surface through an adhesive layer.

3. The device of claim 1 wherein the stiff support body is rectangular in shape.

4. The device of claim 1 wherein the stiff support body has an oval shaped aperture.

5. The device of claim 1 wherein the stiff support body is square in shape.

6. The device of claim 1 wherein the stiff support body has a circular shaped aperture.

7. The device of claim 1 wherein the stiff support body is circular in shape.

8. The device of claim 1 wherein the stiff support body is made of polyolefin type plastic material.

9. The device of claim 7 wherein the stiff support body has an oval shaped aperture.

10. The device of claim 1 wherein the stiff support body forms a passageway that permits gas to flow through the passageway when said flexible film is in the open position and prevents gas from flowing through the passageway when the flexible film is in the closed position.

11. The device of claim 1 wherein said flexible film is made from polyethylene terephthalate.

12. The device of claim 1 wherein the stiff support body has a stiffness between around 500 gram-centimeters and around 800 gram-centimeters.

13. The device of claim 1 wherein the stiff support body has a stiffness between around 700 gram-centimeters and around 800 gram-centimeters.

14. The device of claim 1 wherein the stiff support body consists of polyester, polyolephin, polystyrene, polypropylene or polycarbonate.

15. The device of claim 14 wherein the stiff support body has a stiffness between around 500 gram-centimeters and around 800 gram-centimeters.

16. The device of claim 14 wherein the stiff support body has a stiffness between around 700 gram-centimeters and around 800 gram-centimeters.

17. A pressure relief valve mountable on a packaging surface comprising:

a stiff support body mountable to a support surface defining an aperture and having a stiffness between around 300 gram-centimeters and around 800 gram-centimeters;

a flexible film, said film having a surface moveable between a closed and open position;

two opposing rails mounted above said flexible film holding said flexible film to said stiff support body, said rails defining a channel;

wherein, in said closed position, said film extends into said aperture and covers said aperture; and in said open position said film is located above said aperture to permit a gas to flow through said aperture;

and wherein said stiff support body does not conform with any curvature of the packaging surface such that the flexible film may move between an open and closed position regardless of the curvature of the packaging surface.

18. The device of claim 17 wherein the stiff support body is rectangular in shape.

19. The device of claim 17 wherein the stiff support body has an oval shaped aperture.

20. The device of claim 17 wherein the stiff support body is square in shape.

21. The device of claim 17 wherein the stiff support body has a circular shaped aperture.

22. The device of claim 17 wherein the stiff support body is circular in shape.

23. The device of claim 17 wherein the stiff support body is made of polyester, polyolephin, polystyrene, polypropylene or polycarbonate material.

24. The device of claim 14 wherein the stiff support body has an oval shaped aperture.

25. The device of claim 14 wherein the stiff support body forms a passageway that permits gas to flow through the passageway when said flexible film is in the open position and prevents gas from flowing through the passageway when said flexible film is in the closed position.

26. The device of claim 17 wherein the flexible film consists of polyethylene terephthalate.

27. The device of claim 17 wherein said stiff support body is adhered to the packaging surface through an adhesive layer.

* * * * *